United States Patent [19]

Weatherston

[11] 4,215,977

[45] Aug. 5, 1980

[54] PULSE-FREE BLOWER

[75] Inventor: Roger C. Weatherston, Williamsville, N.Y.

[73] Assignee: Calspan Corporation, Buffalo, N.Y.

[21] Appl. No.: 851,077

[22] Filed: Nov. 14, 1977

[51] Int. Cl.[3] ..... F04C 17/04; F04C 29/08

[52] U.S. Cl. ..... 418/1; 418/78; 418/180; 418/206

[58] Field of Search ..... 418/78, 86, 180, 205, 418/206, 1

[56] References Cited

U.S. PATENT DOCUMENTS

| | | | |
|---|---|---|---|
| 1,252,160 | 1/1918 | Pagel | 418/205 |
| 2,489,887 | 11/1949 | Houghton | 418/86 |
| 2,665,057 | 1/1954 | Walter | 418/180 |
| 2,871,794 | 2/1959 | Mosbacher | 418/206 |
| 3,531,227 | 9/1970 | Weatherston | 418/180 |
| 3,667,874 | 6/1972 | Weatherston et al. | 418/206 |

FOREIGN PATENT DOCUMENTS

| | | | |
|---|---|---|---|
| 309685 | 4/1929 | United Kingdom | 418/206 |

*Primary Examiner*—John J. Vrablik

*Attorney, Agent, or Firm*—Allen J. Jaffe; David J. Zobkiw

[57] ABSTRACT

A three-lobe Root's blower is provided with feed back structure to bring the gas trapped in the impeller well volumes up to the discharge pressure prior to delivery. An essentially uniform and pulse-free discharge is produced by having a constant feed back flow rate which is achieved by always having a trapped impeller well volume in communication with the outlet via feed back structure which is sized to yield a continuous feed back flow rate.

19 Claims, 7 Drawing Figures

PULSE-FREE BLOWER

In the classical Root's blower the well fill process is virtually instantaneous. The benefits of filling the impeller well volume gradually by means of feed back slots as an improvement over the classical Root's blower is known in the prior art as exemplified by U.S. Pat. No. 3,531,227. Thus the very sharp discharge flow pulsations of the classical Root's blower can be reduced by bringing the trapped gas in each impeller well volume gradually to the discharge pressure level before or at the time that each well volume becomes exposed to the discharge region. While the prior art devices teach reduction of very sharp discharge flow pulsations, all pulsations are not thereby eliminated.

It is an object of this invention to provide a blower having a generally uniform and pulse free discharge flow.

It is a further object of this invention to provide a quieter blower.

It is an additional object of this invention to reduce the loading and fatigue of attached equipment and the aerodynamic tare power on the blower itself due to non-steady flow effects. These objects, and others as will become apparent hereinafter, are accomplished by the present invention.

In a blower, the discharge flow rate is essentially controlled by two dominant parameters. The first is the displacement rate of the impellers proper. At a given speed, this rate is a constant except for small cyclic variations due to the impeller geometry which, from a practical standpoint, are negligible and the impeller displacement rate can be considered to be essentially constant. The second parameter affecting the discharge flow rate is the flow rate of the feed back gas into the impeller well volumes. In simple terms, the instantaneous discharge flow rate can be stated as:

Discharge Flow Rate=Impeller Displacement Rate-Feed Back Flow Rate Since the impeller displacement rate is constant, it is obvious that the feed back flow rate must also be constant for the discharge flow rate to be constant. The only way that this can be attained is for the feed back flow rate to be continuous.

Basically, the present invention is directed to a Root's type blower having three, or more, lobes and which has a pulse-free output. Continuous feed back is provided to each of the impeller well volumes during portions of their rotational cycle to achieve a constant feed back flow rate.

BRIEF DESCRIPTION OF THE DRAWINGS

For a fuller understanding of the present invention, reference should now be made to the accompanying detailed description of the same taken in conjunction with the accompanying drawings, wherein.

Figure 1:
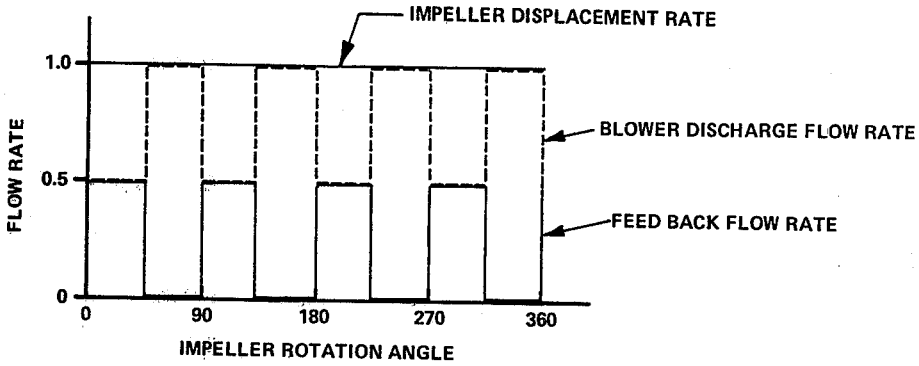
FIG. 1 is an idealized illustration of the blower discharge flow rate for a two-lobe Root's blower with feed back slots set back 45° from the housing extremities on the discharge side.

In a two-lobe construction, the angular travel from tip to tip is 180°. If properly sized feed back slots are placed 90° back from the points where the impeller wells would become exposed to the discharge region in the absence of feed back passages or slots, one feed back slot would be active for 90° of impeller rotation of one impeller followed immediately by the activation of the opposite slot on the second impeller. In this fashion the discharge flow rate could be theoretically held constant. As a practical matter, however, the set back angle of the feed back slots cannot exceed about 45° in a two-lobe device else the gas entering the impeller well volume from the slots would leak back out of the inlet side of the impellers. Hence, the maximum amount of discharge flow smoothing that can be actually achieved in a two-lobe design is substantially limited. Flow pulsations for a two-lobe Root's blower with feed back slots set back 45° are shown in FIG. 1. It will be noted that there are severe pulsations in the discharge region despite the fact that the impeller well volumes were assumed to have been filled by the feed back slots. Hence, bringing the well volumes up to outlet pressure prior to their exposure to the discharge area is, in itself, insufficient to eliminate discharge pulsations.

Figure 2:
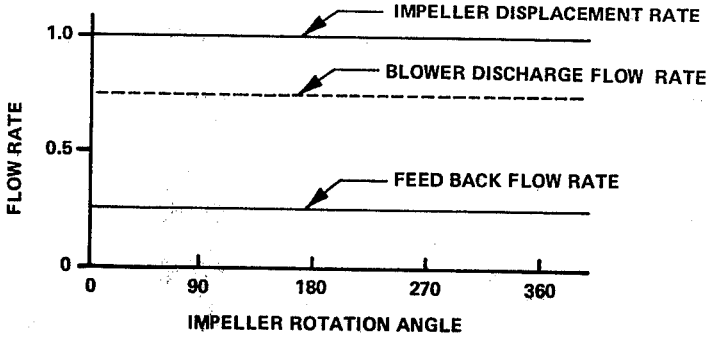
FIG. 2 is an idealized illustration of the blower discharge flow rate for a three-lobe Root's blower with feed back slots set back 60° from the housing extremities on the discharge side.

In the case of a three-lobe impeller construction, angular travel from tip to tip is only 120°. If each feed back slot is set back half this distance, 60°, as will become apparent hereinbelow, one of the well volumes is always trapped and it is possible to have one or the other of the feed back slots active all of the time. Assuming a proper sizing of these slots, the idealized flow rate from the blower can be held constant as illustrated in FIG. 2.

Depending upon impeller configurations, clearances, etc., actual construction may dictate the employment of additional slots at smaller set back angles to tend to hold the total feed back flow rate at a constant value as the pressure rises in the impeller well during the fill process. The important feature, however, is that, from the onset of the initial feed back, there be a nominal 60° of impeller rotation to bring the wells to essentially the discharge pressure. In addition, the impellers should be similar else the feed back rates may not be the same from each impeller well fill action.

DESCRIPTION OF THE PREFERRED EMBODIMENTS

Figure 3:
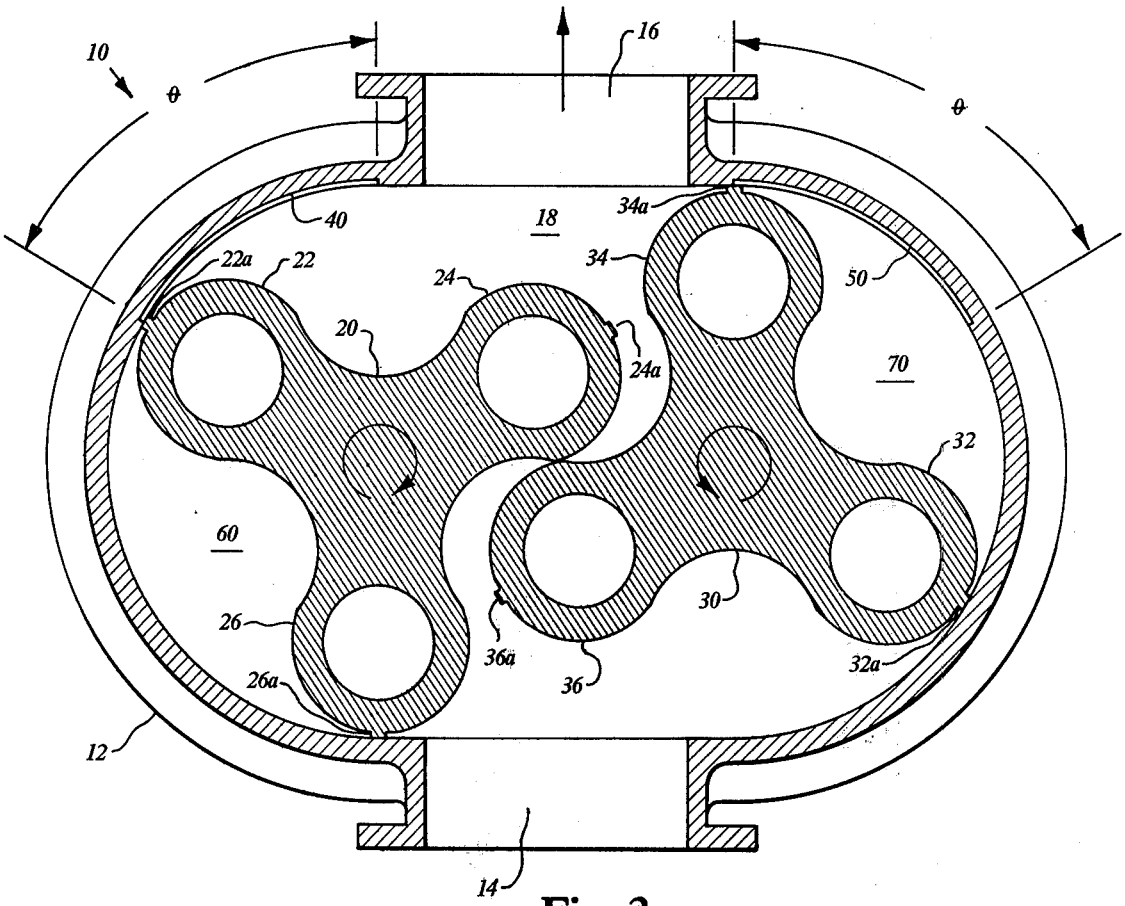
FIG. 3 is a sectional view of a three-lobe Root's blower employing the present invention.
Figure 4:
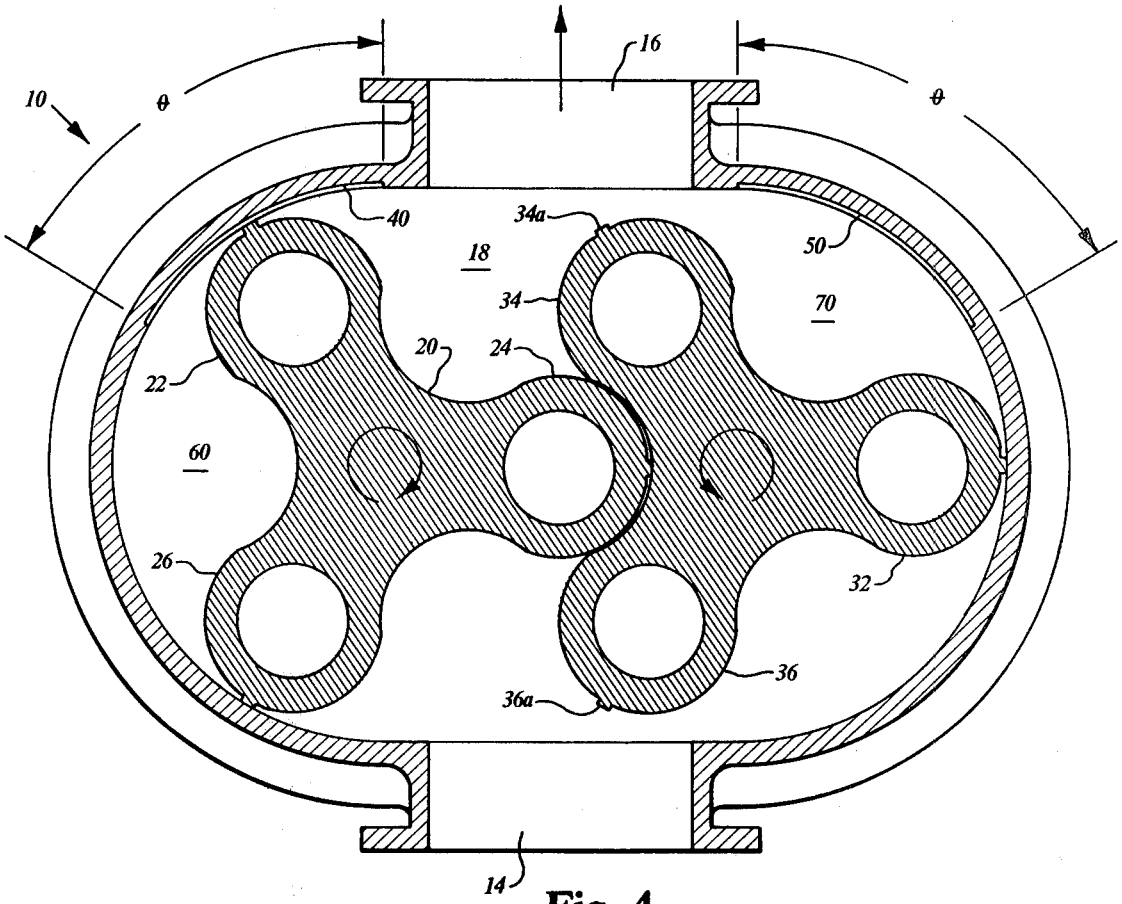
FIG. 4 is the same as FIG. 3 except that the impellers have moved to a new position.

In FIG. 3, the numeral 10 generally designates a three-lobe Root's blower with a continuous, constant-rate feed back configuration. Blower 10 includes a housing 12 having an inlet 14 and an outlet 16 and defining a chamber 18 having an oval cross section in the illustrated view. Impeller 20 having lobes 22, 24 and 26 with tips *22a*, *24a* and *26a*, respectively, and impeller 30 having lobes 32, 34 and 36 with tips *32a*, *34a* and *36a*, respectively, are located in chamber 18 and are in sliding sealing engagement with each other and with the inside walls of housing 12. Feed back slots 40 and 50 are located in housing 12 and each operatively extends over an angle $\theta$ from the top most position of the respective impeller lobes in a direction away from the outlet 16. In the three-lobe device of FIG. 3, the angle $\theta$ will be a nominal 60° as will be explained in detail below. FIG. 3 illustrates a transitional point in which the gas in impeller well volume 60 is trapped between lobes 22 and 26 and is at inlet pressure and is about to be exposed to outlet pressure via feed back slot 40 and in which the gas in impeller well volume 70 has been exposed to outlet pressure via feed back slot 50 and is at outlet pressure and is about to be in free communication with the outlet 16. FIG. 4 illustrates a position in which the gas in impeller well volume 60 is about halfway up to outlet pressure via feed back slot 40 and in which the gas in impeller well volume 70 is completely exposed to the outlet region.

Figure 7:
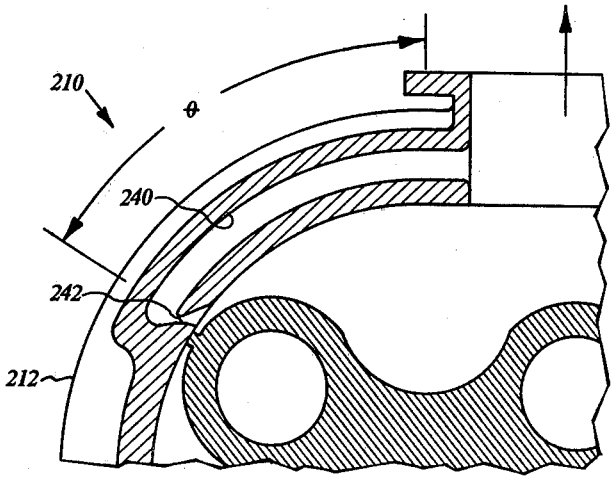
FIG. 7 is a partial sectional view of a third modified feed back arrangement.
Figure 5:
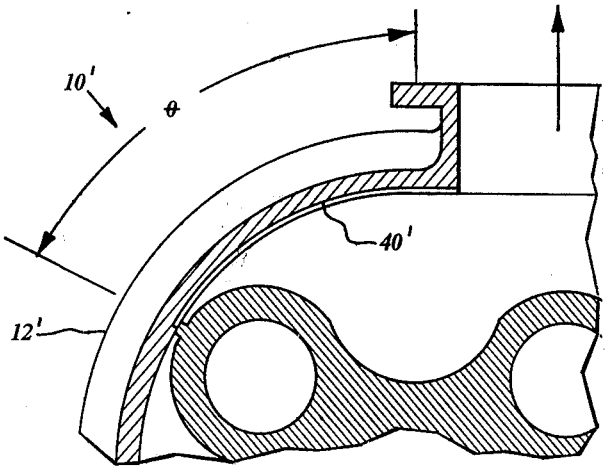
FIG. 5 is a partial sectional view of a first modified feed back arrangement.
Figure 6:
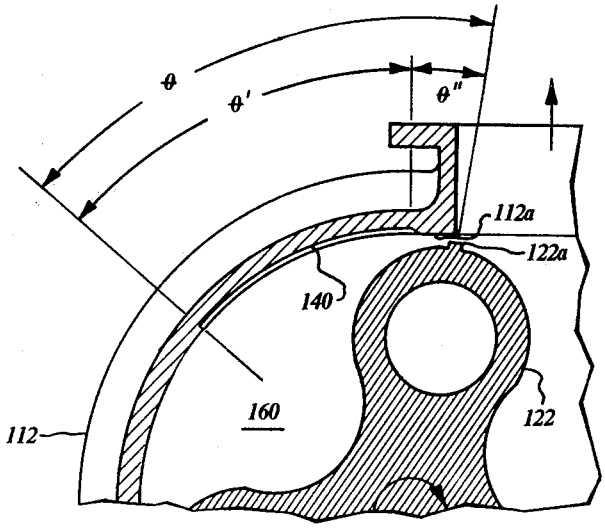
FIG. 6 is a partial sectional view of a second modified feed back arrangement.

FIG. 5 illustrates a modified feed back slot 40' which extends an additional distance through housing 12' of blower 10' for ease of manufacture. FIG. 6 illustrates the use of the restricted flow path between the tip 122a of impeller lobe 122 and the wall of housing 112 to provide a feed back flow path through the angle $\theta''$ in addition to the use of slot 140 over the angle $\theta'$ as described above. The unslotted portion 112a of the housing 112 acts in conjunction with the tip 122a of impeller lobe 122 to provide a restricted communication of the outlet region with the impeller well 160 and, in effect, provides for a restricted communication in the absence of an actual slot. In essence, then, a 60° slot-like restricted communication action can be achieved in a slot of less than 60° of arcuate length. FIG. 7 illustrates a third modified feedback structure in which passage 240 in housing 212 of blower 210 communicates outlet pressure with the impeller well volume via nozzle 242 prior to the delivery of the impeller well volume.

OPERATION

In the operation of the blower 10, as depicted in FIGS. 3 and 4, an essentially constant feed back takes place at all times in order to achieve a constant discharge flow rate as discussed above. The flow fill process into the wells can be controlled and kept essentially constant for 60° of impeller rotation as shown in FIGS. 3–6 in which the interior housing wall is recessed to allow feed back flow to be metered into the wells by flowing between the impeller tips and housing over 60° of impeller rotation. In the blower 210 of FIG. 7 the well fill gas is introduced onto the rearward face of the lobe to contribute a jet assist effect and to reduce the power required. It will be noted that the slots 40 and 50 start rather abruptly about 60° back from the extremity of the housing 12. The depth of the slots 40 and 50 can be increased toward the outlet to insure a constant flow rate into the impeller wells as the pressure rises therein but for high pressure ratios (say about 1.5, or higher) this is less important.

The most important consideration is that the feed back flow be relatively constant and take place during 60° of impeller rotation to bring the well to essentially the discharge pressure level followed immediately by the initiation of the fill process in the other impeller. For proper operation, it is essential that the impellers be similar and that the feed back flow be continuous yet alternating between the impellers. In a three-lobe blower the actual slot length may vary from about 50° (FIG. 6) to 80° (FIG. 5) but the well filling process should take place during essentially 60° of impeller rotation in order to insure that the total feed back flow is continuous.

There is an additional consideration that alters somewhat the significance of the fill time for 60° of impeller rotation, when it is recognized that the objective is a constant flow from the discharge area proper. As illustrated in FIG. 3, impeller well volume 70 has just completed its fill process. If the effect of the well filling process for impeller well volume 60 is not immediately felt in the discharge area there will be no feed back flow component manifested there and the discharge flow rate would therefore immediately increase to the impeller displacement rate. The expansion wave, signaling the onset of the feed back flow into impeller well volume 60, does not immediately arrive at the discharge but travels toward the discharge region with the speed of sound in the discharge gas, $a_d$. To account for this time delay it is necessary to advance, somewhat, the beginning of the fill process from the 60° position. The corrected angular travel required for each well fill process is given by the relationship $$\text{Impeller Angular Travel for Well Fill} = \frac{60°}{(1+V_T/a_d)}$$

For an impeller tip velocity, $V_T$, of 105 feet per second and a discharge speed of sound, $a_d$, of 1300 feet per second in air, which represent practical air blower operating conditions, the value of $V_T/a_d$ is about 0.08. The resulting desired angular travel for the fill process is about 65°. For other tip speeds and other gases the value of $V_T/a_d$ may be different. It is obvious that an angular travel time for the well fill process that is only slightly greater or less than 65° would only slightly affect the smoothness of the discharge flow. With the speed of sound correction added, there will be some small overlap in separate impeller well fill processes but this overlap effect will not be manifested in the discharge region.

The cross sectional area (in square inches) of the feed back passage necessary to accomplish the present invention has been found to be between 0.0025 and 0.0075 times the quantity $D_P^2 l(RPM/1000)\psi$ where $D_p$ is the impeller pitch diameter in inches l is the impeller length in inches RPM is the impeller rotational drive speed and $$\psi = \left[\frac{\left(\frac{P_2}{P_1}\frac{T_1}{T_2} - 1\right)\sqrt{\frac{T_2}{T_1}}}{P_2/P_1}\right]\left(1 + \frac{L}{4}\right)$$

where $P_1$ and $P_2$ are the inlet and outlet pressures, respectively $T_1$ and $T_2$ are the inlet and outlet temperatures, respectively and L is the leak fraction of the blower.

As a practical matter, for the operational parameters of a three-lobe blower having a pressure ratio between 1.5 and 2.0 the ideal area varies only about ±10% from the area required at the compression ratio of about 1.75. The area calculation can then be simplified to between 0.0005 and 0.0015 times $D_p^2(RPM/1000)l$. Depending primarily upon manufacturing conditions, the slots may extend the entire axial length of the impeller or a portion thereof with the slot depth varying inversely with the length of the slot. Also, the cross sectional area of the feed back slots may be increased slightly toward the outlet end thereof to accommodate the decreasing pressure ratio between gas in the impeller wells and the outlet. At high blower compression ratios (1.5–2.0), however, this consideration becomes less important.

In all of the disclosed feed back arrangements, the high pressure discharge gas undergoes a controlled expansion process either via the nozzle configuration 242 of FIG. 7 or via the sequential narrowing and opening of the feed back flow paths illustrated in FIGS. 3–6 and provided by the rounded impeller tips coacting with the slots and housing. In this manner, the flow process from the high pressure region to the low pressure region is highly efficient and the fill flow rate remains relatively constant as the pressure rises in the impeller wells. When the pressure ratio is less than about 1.1 the feed back flow rate will begin to diminish somewhat, however, at this time, the fill process is virtually complete.

Although preferred embodiments of the present invention have been described and illustrated, other changes will occur to those skilled in the art. It is therefore intended that the scope of the present invention is to be limited only by the scope of the appended claims.

I claim:

1. A method for providing an essentially pulse free discharge flow as perceived at the outlet of a Root's type blower having two impellers each of which having at least three lobes and including the steps of:

running the impellers at an essentially constant speed;

alternately communicating discharge pressure at an essentially constant, predetermined rate to a trapped well volume defined by adjacent lobes of one impeller and the housing prior to exposure to the outlet followed by similarly communicating discharge pressure to a trapped well volume of the other impeller; and providing an essentially constant and continuous feed back flow as perceived at the outlet whereby at least one of the trapped well volumes is being filled at all times and brought up to essentially outlet pressure prior to its direct communication with said outlet.

2. The method of claim 1 wherein feed back flow takes place during an angular displacement of essentially one half of the tip to tip arcuate distance between adjacent lobes.

3. The method of claim 1 wherein feed back flow to each trapped well volume takes place over 50° to 80° of rotation of the impellers.

4. The method of claim 1 wherein the essentially constant and continuous feed back flow is provided by establishing sequential fluid communication between the outlet and the trapped well volumes of one impeller and then the other in a cyclic manner.

5. A Root's type of blower having an essentially pulse free output as perceived at the outlet of the blower comprising:

a housing having an inlet, an outlet and walls defining a cavity therein;

two rotary impellers having at least three lobes each located in said cavity in a coacting relationship with each other and with the walls of said cavity;

first feed back means operative for controlling fluid communication and providing an essentially constant feed back flow between said outlet and each of the trapped wells defined by adjacent lobes of one of said impellers and the walls of said cavity during respective portions of the rotational cycle of said one of said impellers approximating one half of the tip to tip arcuate distance between adjacent lobes of said one of said impellers;

second feed back means operative for controlling fluid communication and providing an essentially constant feed back flow between said outlet and each of the trapped wells defined by adjacent lobes of the other of said impellers and the walls of said cavity during respective portions of the rotational cycle of the other of said impellers which correspond to the remaining portions of the rotational cycle of said one of said impellers;

whereby each of the trapped wells is brought up to essentially outlet pressure prior to its direct communication with said outlet by providing alternating fluid communication between said outlet and a trapped well of said one impeller via said first feed back means followed by providing fluid communication between said outlet and a trapped well of said other impeller via said second feed back means in a cyclic manner such that the feed back flow remains essentially constant and continuous as perceived at the outlet of the blower and the output of said blower is essentially pulse free.

6. The blower of claim 5 wherein said impellers have three lobes each and said first and second feed back means are each operative during essentially 60° rotation of said impellers.

7. The blower of claim 5 wherein said first and second feed back means are slots extending between 50° and 80° of arcuate length.

8. The blower of claim 5 wherein said first and second feed back means are symmetrically located with respect to said outlet.

9. The blower of claim 5 wherein said first and second feed back means provide for essentially constant feed back flow to each of the trapped wells during at least 50° of rotation by said impellers.

10. The blower of claim 5 wherein the average cross sectional area of each of said first and second feed back means is between 0.0005 and 0.0015 times $(D_p^2)l(RPM/1000)$ where $D_p$ is the impeller pitch diameter, l is the impeller length and RPM is the impeller rotational drive speed.

11. The blower of claim 5 wherein said first and second feed back means each include an internal housing passage communicating outlet pressure with the cavity at a point set back an arcuate distance of at least 60° from said outlet.

12. The blower of claim 11 wherein the smallest cross sectional area of each of said first and second feed back means is between 0.0005 and 0.0015 times $(D_p^2)l(RPM/1000)$ where $D_p$ is the impeller pitch diameter, l is the impeller length and RPM is the impeller rotational device speed.

13. A Root's type of blower having an essentially pulse free output as perceived at the outlet of the blower and including:

a housing having an inlet, an outlet and walls defining a cavity therein;

two similar three-lobed rotary impellers located in said cavity in a coacting relationship with each other and the walls of said cavity whereby trapped fluid well volumes are formed between adjacent lobes of each of said impellers and the walls of said cavity;

first feed back means for providing fluid communication at an essentially constant rate between said outlet and each of the trapped fluid well volumes defined by the adjacent lobes of one of said impellers and the walls of said cavity during respective portions of the rotational cycle of said one of said impellers approximating one half of the tip to tip arcuate distance between adjacent lobes of said one of said impellers;

second feed back means for providing fluid communication at an essentially constant rate between said outlet and each of the trapped fluid well volumes defined by the adjacent lobes of the other one of said impellers and the walls of said cavity during respective portions of the rotational cycle of the other of said impellers which correspond to the remaining portions of the rotational cycle of said one of said impellers;

whereby each of the trapped wells is brought up to essentially outlet pressure prior to its direct communication with said outlet by providing alternating fluid communication between said outlet and a trapped well of said one impeller via said feed back means followed by providing fluid communication between said outlet and a trapped well of said other impeller via said second feed back means in a cyclic manner such that the feed back flow remains essentially constant and continuous as perceived at the outlet of the blower and the output of said blower is essentially pulse free.

14. The blower of claim 13 wherein said first and second feed back means are symmetrical and are in alternating continuous fluid communication between said outlet and said trapped fluid well volumes.

15. The blower of claim 13 wherein said first and second feed back means are slots extending between 50° and 80° of arcuate length.

16. The blower of claim 13 wherein said first and second feed back means provide for essentially constant feed back flow to each of the trapped fluid well volumes during at least 50° of rotation by said impellers.

17. The blower of claim 13 wherein the average cross sectional area of each of said first and second feed back means is between 0.0005 and 0.0015 times $(D_p^2)l(RPM/1000)$ where $D_p$ is the impeller pitch diameter, l is the impeller length and RPM is the impeller rotational drive speed.

18. The blower of claim 13 wherein said first and second feed back means each include an internal passage communicating outlet pressure with the cavity at a point set back an arcuate distance of at least 60° from said outlet.

19. The blower of claim 18 wherein the smallest cross sectional area of each of said first and second feed back means is between 0.0005 and 0.0015 times $(D_p^2)l(RPM/1000)$ where $D_p$ is the impeller pitch diameter, l is the impeller length and RPM is the impeller rotational drive speed.

* * * * *